US010183192B2

(12) United States Patent
Waldman

(10) Patent No.: US 10,183,192 B2
(45) Date of Patent: Jan. 22, 2019

(54) THERAPEUTIC HAND-HELD EXERCISE DEVICE

(71) Applicant: Barrett Productions, LLC, Newton, MA (US)

(72) Inventor: Dennis Waldman, Newton, MA (US)

(73) Assignee: Barrett Productions, LLC, Newton, MA (US)

( * ) Notice: Subject to any disclaimer, the term of this patent is extended or adjusted under 35 U.S.C. 154(b) by 152 days.

(21) Appl. No.: 14/991,300

(22) Filed: Jan. 8, 2016

(65) Prior Publication Data

US 2016/0235613 A1 Aug. 18, 2016

Related U.S. Application Data

(60) Provisional application No. 62/101,446, filed on Jan. 9, 2015.

(51) Int. Cl.

| | |
|---|---|
| ***A63B 23/12*** | (2006.01) |
| ***A63B 23/16*** | (2006.01) |
| ***A63B 21/055*** | (2006.01) |
| ***A63B 21/00*** | (2006.01) |
| ***A63B 21/04*** | (2006.01) |
| *A63B 21/02* | (2006.01) |
| *A45F 5/10* | (2006.01) |

(52) U.S. Cl.

CPC ..... *A63B 23/16* (2013.01); *A63B 21/0004* (2013.01); *A63B 21/00061* (2013.01); *A63B 21/0421* (2013.01); *A63B 21/0552* (2013.01); *A63B 21/0557* (2013.01); *A45F 2005/1013* (2013.01); *A63B 21/00069* (2013.01); *A63B 21/023* (2013.01); *A63B 21/4039* (2015.10)

(58) Field of Classification Search

CPC ..... A63B 21/4035; A63B 21/4033

See application file for complete search history.

(56) References Cited

U.S. PATENT DOCUMENTS 1,843,819 A * 2/1932 Jackson ..... B25B 7/06 30/266

4,859,167 A * 8/1989 Maerz ..... A47J 43/282 425/276

(Continued)

*Primary Examiner* — Loan H Thanh

*Assistant Examiner* — Rae Fischer

(74) *Attorney, Agent, or Firm* — Carter, Deluca, Farrell & Schmidt, LLP

(57) ABSTRACT

A therapeutic hand-held exercise device includes a pair of movable members that each define a handle portion and an end effector portion. The movable members are pivotably connected for relative pivotal movement between a first position and a second position. The handle portion of one of the movable members defines at least one flexible member engaging post. The end effector portion of the other movable member defines at least one flexible member engaging post such that the flexible member engaging posts can receive a common flexible member. The flexible member engaging posts are joined via a first common flexible member and other flexible member engaging posts are joined via a second common flexible member. The common flexible members may each exhibit a tensile strength that provides resistance to movement which either differs from or is equal to the tensile strength of the other common flexible member.

16 Claims, 9 Drawing Sheets

(56) References Cited

U.S. PATENT DOCUMENTS 5,303,500 A * 4/1994 Luukonen ..... A01K 97/01
206/315.11
5,720,701 A * 2/1998 Truini ..... A63B 21/0004
482/122

* cited by examiner

THERAPEUTIC HAND-HELD EXERCISE DEVICE

CROSS-REFERENCE TO RELATED APPLICATIONS

This application claims the benefit of, and priority to, U.S. Provisional Patent Application No. 62/101,446 filed on Jan. 9, 2015, entitled "THERAPY TONGS", by D. Waldman, the entire contents of which is incorporated herein by reference.

BACKGROUND

1. Technical Field

The present disclosure relates to devices operated by persons for physical and occupational therapy and the like and more particularly to devices operated manually by said persons.

2. Discussion of Related Art

In both physical and occupational therapy, therapists often have their patients emulate movement and function they would manually perform around the home. A good example is the use of tongs. Tongs can be used to manually grasp something from a barbecue, flip something, toss a salad, or grab any object such as something that may have fallen on the floor out of reach. Similar to tongs, scissors are an example of another household device that involves manual operation. Not only are scissors important for their normal function of cutting material such as paper and the like but scissor action is fundamental in a child's fine motor skill development.

A pathological condition called radial neuropathy (radial nerve palsy) is caused by injury to the radial nerves. In such cases, the person experiences difficulty in opening his or her hand. Similarly, many people with hand injuries or strokes have limited mobility and can only open their hands slightly.

SUMMARY

The embodiments of the present disclosure include a variable resistance tong or scissor device to effect physical or occupational therapy in the above-mentioned situations. In embodiments, resistance of the device can be varied using different strength rubber bands. The device may provide the following benefits over the prior art:

1. The device may strengthen the finger muscles while being used to pick up objects.
2. The device may help build fundamental small motor skills.
3. The device may assist in opening the hand(s) for persons having radial neuropathy.

The present disclosure relates to a therapeutic hand-held exercise device that includes a pair of movable members that each define a handle portion and an end effector portion. The movable members are pivotably connected at a pivot located between the handle portion and the end effector portion for relative pivotal movement between a first position and a second position. The handle portion of one of the movable members defines at least one flexible member engaging post. The end effector portion of the other movable member defines at least one flexible member engaging post such that the at least one flexible member engaging posts are configured to receive a common flexible member.

In embodiments, the common flexible member is a first common flexible member, and the end effector portion of the one movable member and the handle portion of the other movable member may each further define at least one flexible member engaging post wherein the flexible member engaging posts are configured with respect to each other to receive a second common flexible member.

In embodiments, the handle portions may be configured to include a finger gripping portion that defines an aperture that is configured to receive at least one finger of a person therethrough.

In embodiments, the end effector portions may be configured as interfacing grasping cups.

In embodiments, the grasping cups may include spaced apart raised dimples to facilitate grasping of an object.

In embodiments, the end effector portions may include spaced apart raised ridges to facilitate grasping of an object.

In embodiments, the end effector portions may be configured as blades of a pair of scissors.

In embodiments, the end effector portions may be configured as a pair of pliers.

In embodiments, the one or more flexible member engaging posts defined on the handle portion of one of the movable members and the one or more flexible member engaging posts defined on the end effector portion of the other movable member may define a first distance therebetween. The one or more flexible member engaging posts defined on the end effector portion of the one of the movable members and the one or more flexible member engaging posts defined on the handle portion of the other movable member may define a second distance therebetween, wherein the first and second distances are equal to one another.

In other embodiments, the first and second distances may differ from one another.

In embodiments, the one or more flexible member engaging posts defined on the handle portion of one of the movable members and the one or more flexible engaging posts defined on the end effector portion of the other movable member are joined via a common flexible member.

In other embodiments, the at least one flexible member engaging post defined on the handle portion of one of the movable members and the at least one flexible engaging post defined on the end effector portion of the other movable member are joined via a first common flexible member and the at least one flexible member engaging post defined on the end effector portion of the one of the movable members and the at least one flexible member engaging post defined on handle portion of the other movable are joined via a second common flexible member.

In embodiments, the first common flexible member and the second common flexible member may each exhibit a tensile strength that provides resistance to movement and the tensile strength of the first common flexible member differs from the tensile strength of the second common flexible member.

In other embodiments, the first common flexible member and the second common flexible member may each exhibit a tensile strength that provides resistance to movement and the tensile strength of the first common flexible member equals the tensile strength of the second common flexible member.

In embodiments, the other movable member may define an arcuate groove in a surface thereof and the one movable member may include a first pivot limiting member that is disposed to be reversibly engageable with the arcuate groove for limiting the relative pivotal motion of the movable members.

In embodiments, the arcuate groove is a first arcuate groove. The other movable member defines a second arcuate groove in a surface thereof and the one movable member includes a second pivot limiting member that is disposed to be reversibly engageable with the second arcuate groove for limiting the relative pivotal motion of the movable members.

In embodiments, the other movable member may include a stop member extending into a path traversed by the one movable member during relative pivotal movement such that the stop member limits movement of the one movable member upon contact therebetween.

The present disclosure relates also to a method of therapeutic exercise that includes accessing a therapeutic hand-held exercise device that includes a pair of movable members each defining a handle portion and an end effector portion. The movable members are pivotably connected at a pivot located between the handle portion and the end effector portion for relative pivotal movement between a first position and a second position. The device includes at least one common flexible member that provides resistance to the relative pivotal movement. The method includes manipulating the therapeutic hand-held exercise device via the handle portion such that the resistance to the relative pivotal movement imparts therapeutic effect.

In embodiments, the method may further include varying the resistance to the relative pivotal movement of the therapeutic hand-held exercise device.

In embodiments, the method may further include grasping an object via the end effector portion via the pivotal movement of the therapeutic hand-held exercise device and manipulating the therapeutic hand-held exercise device via the handle portion such that resistance of the object to the relative pivotal movement imparts therapeutic effect.

BRIEF DESCRIPTION OF THE DRAWINGS

The above-mentioned advantages and other advantages will become more apparent from the following detailed description of the various exemplary embodiments of the present disclosure with reference to the drawings wherein.

DETAILED DESCRIPTION

Figure 1:
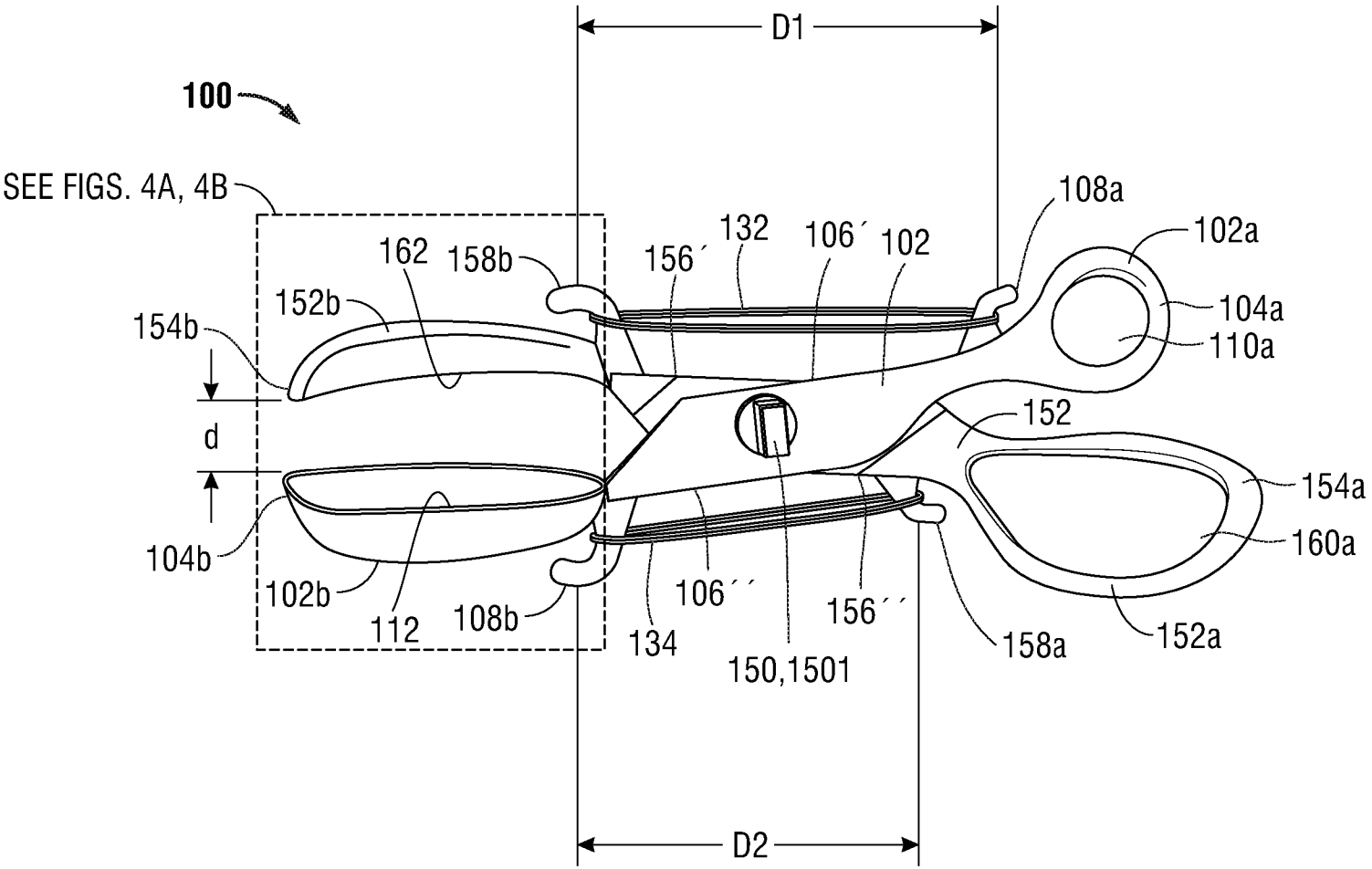
FIG. 1 is a perspective view of one embodiment of a therapeutic device in the form of a pair of variable resistance therapy tongs in a nearly closed position according to the present disclosure.

For the purposes of promoting an understanding of the principles of the present disclosure, reference will now be made to the exemplary embodiments illustrated in the drawings, and specific language will be used to describe the same. It will nevertheless be understood that no limitation of the scope of the present disclosure is thereby intended. Any alterations and further modifications of the inventive features illustrated herein, and any additional applications of the principles of the present disclosure as illustrated herein, which would occur to one skilled in the relevant art and having possession of this disclosure, are to be considered within the scope of the present disclosure.

The word "exemplary" is used herein to mean "serving as an example, instance, or illustration." Any embodiment described herein as "exemplary" is not necessarily to be construed as preferred or advantageous over other embodiments.

It is to be understood that the method steps described herein need not necessarily be performed in the order as described. Further, words such as "thereafter," "then," "next," etc., are not intended to limit the order of the steps. Such words are simply used to guide the reader through the description of the method steps.

As described above, the embodiments of the present disclosure relate to a variable resistance tong or scissor device to effect physical or occupational therapy in the above-mentioned situations. In embodiments, resistance of the device can be varied using different strength rubber bands. The device may provide the following benefits:

1. The device may strengthen the finger muscles while being used to pick up objects.
2. The device may help build fundamental small motor skills.
3. The device may assist in opening the hand(s) for persons having radial neuropathy.

FIG. 1 illustrates one embodiment of a therapeutic hand-held exercise device 100 that includes a pair of movable members 102, 152 each defining a handle portion 102*a*, 152*a* at proximal ends 104*a*, 154*a* and an end effector portion 102*b*, 152*b* at distal ends 104*b*, 154*b*, respectively. The movable members 102, 152 are pivotably connected at a pivot 150 located between the handle portions 102*a*, 152*a* and the end effector portions 102*b*, 152*b* for relative pivotal movement between at least a first position and a second position. The handle portion 102*a* of one of the movable members 102 defines at least one flexible member engaging post 108*a*. The end effector portion 152*b* of the other movable member 152 defines at least one flexible member engaging post 158*b* such that the flexible member engaging posts 108*a* and 158*b* are configured to receive a common flexible member 132.

In the example embodiment of FIG. 1, the movable members 102 and 152 each define first and second lateral sides 106' and 106" and 156' and 156", respectively, that may be configured with at least one flexible member engaging post 108*a* positioned on the first lateral side 106' in proximity to the finger gripping or handle portion 102*a* of the one of the movable members 102.

The movable member 152 that defines first and second lateral sides 156' and 156" may be configured with at least one flexible member engaging post 158*b* positioned on the first lateral side 156' in proximity to the end effector portion 152*b* of the movable member 152.

The common flexible member 132 may be a first common flexible member and the end effector portion 102*b* of the one of the movable members 102 and the handle portion 152*a* of the other movable member 152 may each further define at least one flexible member engaging post 108*b* and 158*a* respectively wherein the flexible member engaging posts 108*b* and 158*a* are configured with respect to each other on lateral sides 106" and 156", respectively, to receive a second common flexible member 134.

The handle portions 102*a* and 152*a* are configured to include a finger gripping portion 110*a* and 160*a* that defines an aperture that is configured to receive at least one finger of a person therethrough (not shown).

Figure 2:
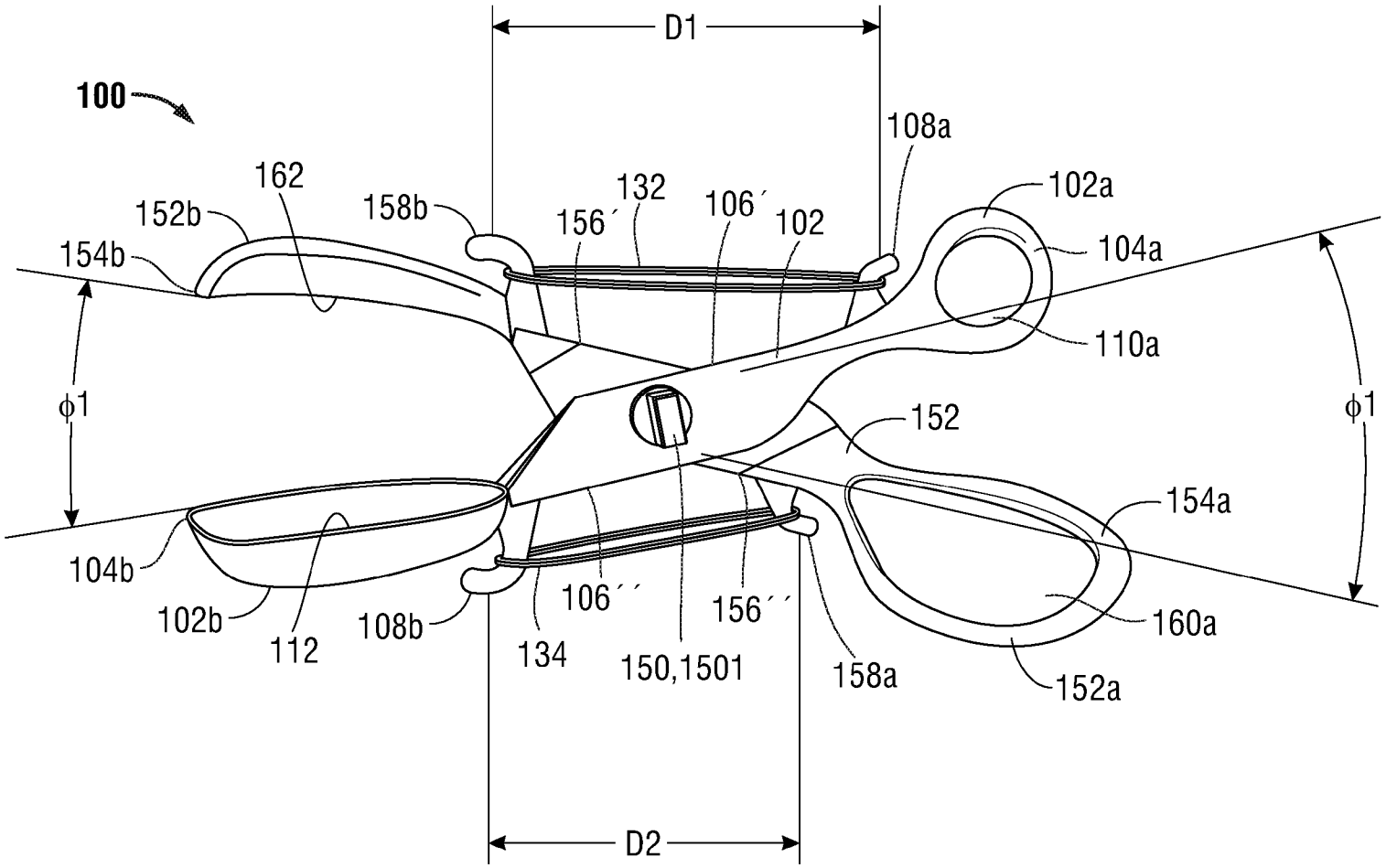
FIG. 2 is a perspective view of the embodiment of the therapeutic device in the form of the pair of variable resistance therapy tongs of FIG. 1 in an open position according to the present disclosure.
Figure 3:
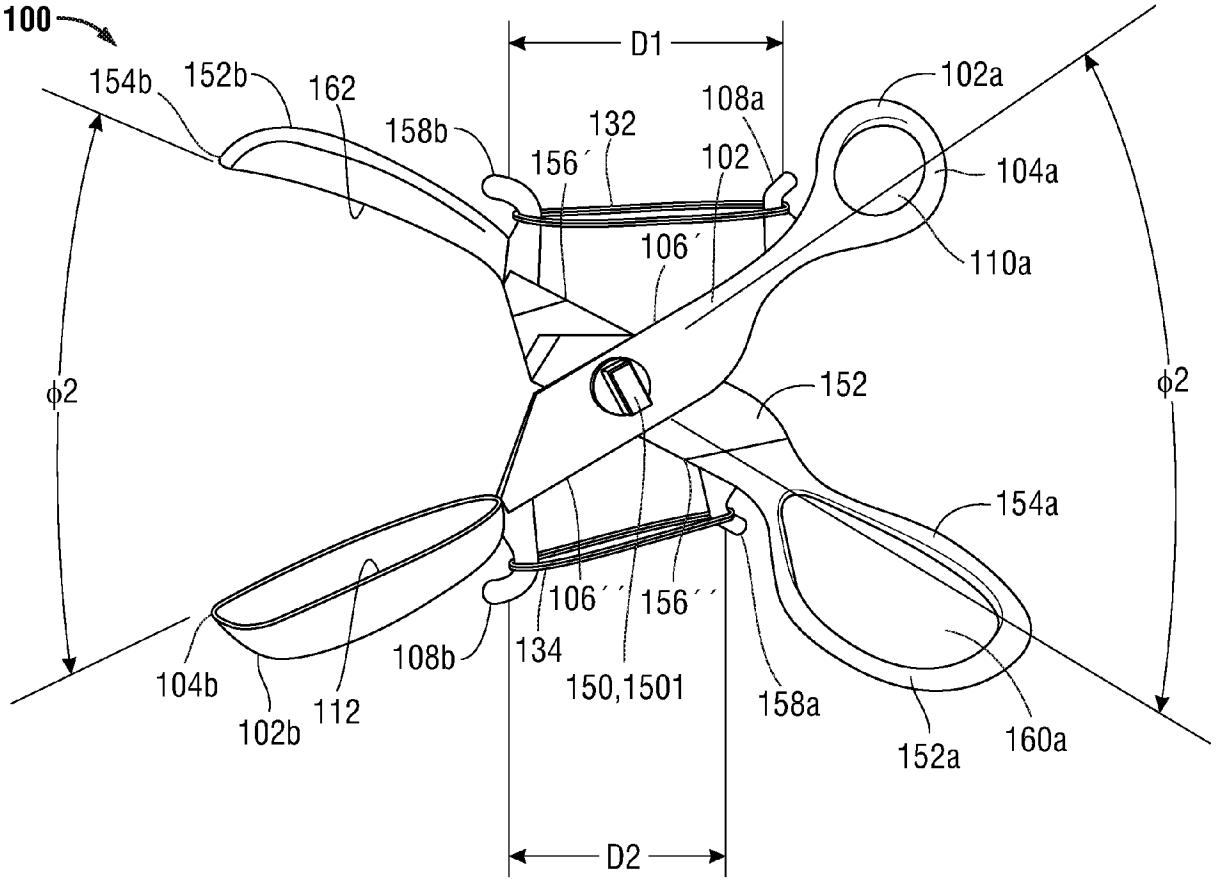
FIG. 3 is a perspective view of the embodiment of the therapeutic device in the form of the pair of variable resistance therapy tongs of FIG. 1 in an extended open position according to the present disclosure.

In embodiments, also as illustrated in FIGS. 1-3, the flexible member engaging post 108*a* defined on the handle portion 102*a* of movable member 102 and the flexible member engaging post 158*b* defined on the end effector portion 152*b* of the other movable member 152 define a first distance D1 therebetween.

Similarly, the flexible member engaging post 108*b* defined on the end effector portion 102*b* of the movable member 102 and the flexible member engaging post 158*a* defined on the handle portion 152*a* of the other movable member 152 define a second distance D2 therebetween. In the example embodiment of FIGS. 1-3, the first and second distances D1 and D2 differ from one another, and more particularly, D1 is greater than D2.

The first common flexible member 132, e.g., a rubber band or a shape-memory material as illustrated or a spring (not shown), and the second common flexible member 134 each exhibit a tensile strength or elasticity that provides resistance to movement. In example embodiments, the tensile strength or elasticity of the first common flexible member 132 may equal the tensile strength or elasticity of the second common flexible member 134 such that resistance to movement of the exercise device 100 varies by changes in D1 and D2 and also by the difference of D1 as compared to D2. In other example embodiments, the tensile strength or elasticity of the first common flexible member 132 may differ from the tensile strength or elasticity of the second common flexible member 134 such that resistance to movement of the exercise device 100 varies not only by changes in D1 and D2 and by the difference of D1 as compared to D2 according to the locations of the flexible member engaging posts but also by the differences between tensile strength or elasticity of the first common flexible member 132 and the second common flexible member 134.

In embodiments, still referring to FIGS. 1-3, the end effector portions 102*b* and 152*b* may be configured as interfacing grasping cups 112 and 162, respectively. At the pivot 150, a rotatable knob 1501 may be adjusted as known in the art to enable variation in the positions of the end effector portions 102*b* and 152*b*. For example, as shown in FIG. 1, the end effector portions 102*b* and 152*b* are positioned in a partially open position wherein the interfacing grasping cups 112 and 162 are generally parallel to each other but spaced apart from one another at a distance d.

In FIG. 2, the end effector portions 102*b* and 152*b* are positioned in an open position wherein the interfacing grasping cups 112 and 162 are spaced apart from one another at an angle Φ1 (assumed to have an intersection point at pivot 150) such that the interfacing grasping cups 112 and 162 are spaced apart from one another at distances greater than distance d. Similarly, the handle portions 102*a* and 152*a* are also spaced apart from one another at angle Φ1 (again assumed to have an intersection point at pivot 150).

In a similar manner, in FIG. 3, the end effector portions 102*b* and 152*b* are positioned in a further open position wherein the interfacing grasping cups 112 and 162 are spaced apart from one another at an angle Φ2 (assumed to coincide with the intersection point of angle Φ1 at pivot 150) such that the interfacing grasping cups 112 and 162 are spaced still further apart from one another at distances greater than distance d. Similarly, the handle portions 102*a* and 152*a* are also spaced apart from one another at angle Φ2 (again assumed to have an intersection point at pivot 150).

Thus, the movable members 102 and 152 are pivotably connected at pivot 150 located between the handle portions 102*a* and 152*a* and the end effector portions 102*b* and 152*b* for relative variable pivotal movement between a first position and a second position or additional positions, as represented at least by distance d and angles Φ1 and Φ2.

Figure 4A:
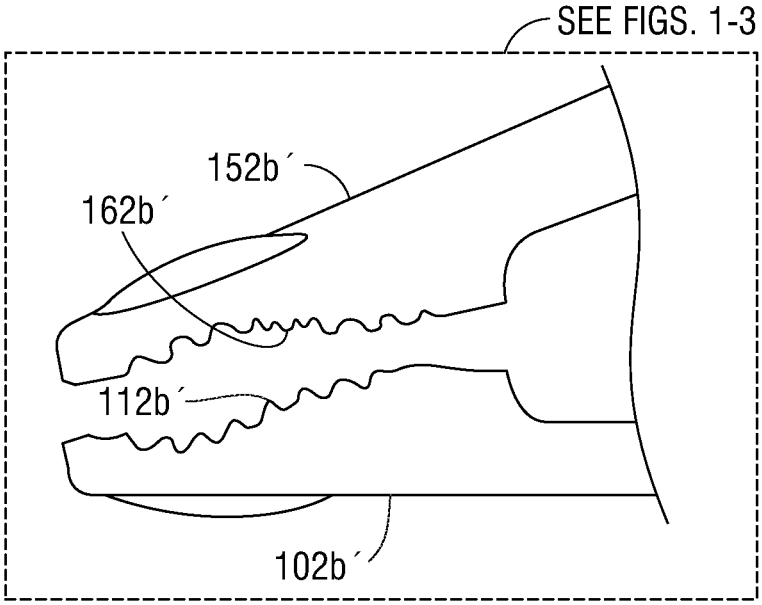
FIG. 4A is a perspective partial view of one embodiment of the therapeutic device in the form of the pair of variable resistance therapy tongs of FIGS. 1-3 wherein the tongs include graspers having a ridged surface, such as in a pair of pliers, to enhance gripping.

FIG. 4A illustrates one embodiment of the therapeutic device 100 in the form of the pair of variable resistance therapy tongs of FIGS. 1-3 wherein the end effector portions 102*b* and 152*b* are replaced by end effector portions 102*b'* and 152*b'* that include graspers each having a ridged surface 112*b'* and 162*b'*, respectively, such as in a pair of pliers, to enhance gripping. The ridged surfaces 112*b'* and 162*b'* may each be arranged in a curved path to form a space therebetween to facilitate receiving an object such as a ball (not shown), which may be flexible and that may be grasped therebetween and manipulated for therapeutic effect by opening and closing the movable members 102 and 152 to vary the angles Φ1 and Φ2.

Figure 4B:
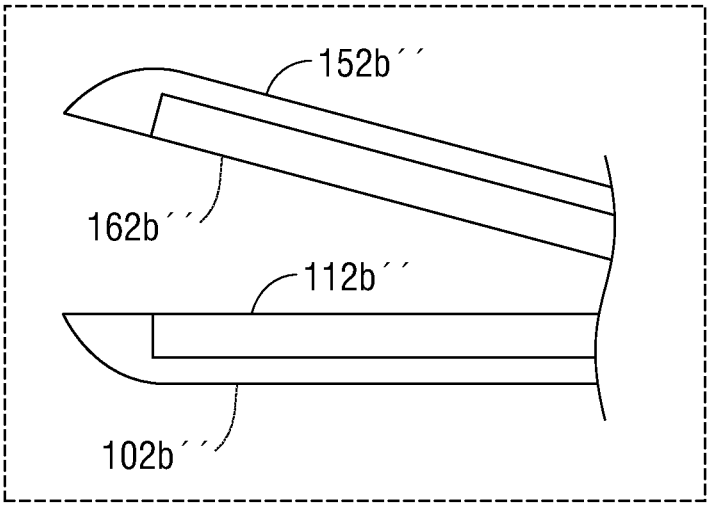
FIG. 4B is a perspective partial view of one embodiment of the therapeutic device wherein the graspers of FIGS. 1-4A are replaced by a pair of scissor blades.

FIG. 4B illustrates one embodiment of the therapeutic device 100 in the form of the pair of variable resistance therapy tongs of FIGS. 1-3 wherein the end effector portions 102*b* and 152*b* are now replaced by end effector portions 102*b"* and 152*b"* that are in the form of pair of scissor blades 112*b"* and 162*b"*. The scissor blades 112*b"* and 162*b"* may be manipulated by grasping a material, such as, for example, cloth or paper (not shown), so as to provide a therapeutic effect via the resistance to shearing of the material.

Thus, the end effector portions 102*b*, 102*b'*, 102*b"* and 152*b*, 152*b'*, 152*b"*, respectively, pivot in an arc extending in a path defined by at least angles Φ1 and Φ2.

Figure 5:
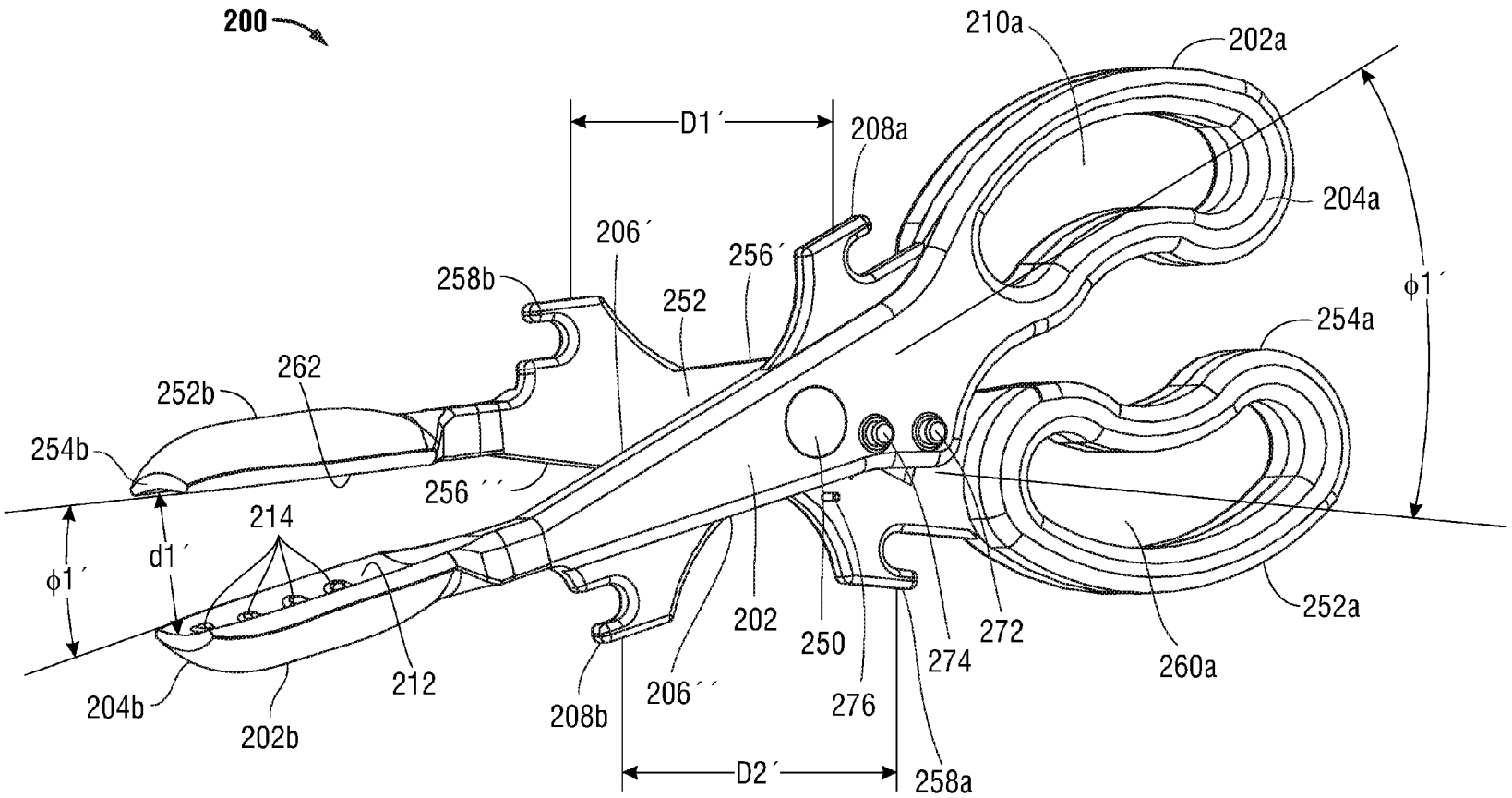
FIG. 5 is a perspective view of another embodiment of a therapeutic device in the form of a pair of variable resistance therapy tongs in a partially open position according to the present disclosure wherein the tongs include graspers having a dimpled surface to enhance gripping.

FIG. 5 illustrates another embodiment of a hand-held therapeutic exercise device according to the present disclosure, i.e., therapeutic device 200, again including a pair of movable members designated 202, 252 that are characterized by an enhanced ergonomic design as compared to the therapeutic exercise device 100 and a different position locking means that is described in more detail below.

In a similar manner, the pair of movable members 202, 252 each define a handle portion 202*a*, 252*a* at proximal ends 204*a*, 254*a* and end effector portion 202*b*, 252*b* at distal ends 204*b*, 254*b*, respectively. The movable members 202, 252 are pivotably connected at pivot 250 located between the handle portions 202*a*, 252*a* and the end effector portions 202*b*, 252*b* for relative pivotal movement between at least a first position and a second position. The handle portion 202*a* of one of the movable members 202 defines at least one flexible member engaging post 208*a*. The end effector portion 252*b* of the other movable member 252 defines at least one flexible member engaging post 258*b* such that the flexible member engaging posts 208*a* and 258*b* are configured to receive a common flexible member 132 (as shown in FIGS. 1-3).

In the example embodiment of FIG. 5, in a similar manner, the movable members 202 and 252 each define first and second lateral sides 206' and 206" and 256' and 256", respectively, that may be configured with at least one flexible member engaging post 208*a* positioned on the first lateral side 206' in proximity to the finger gripping or handle portion 202*a* of the one of the movable members 202.

The movable member 252 that defines first and second lateral sides 256' and 256" may be configured with at least one flexible member engaging post 258*b* positioned on the first lateral side 256' in proximity to the end effector portion 252*b* of the movable member 252.

Again, the common flexible member 132 may be a first common flexible member and the end effector portion 202*b* of the one of the movable members 202 and the handle portion 252*a* of the other movable member 252 may each further define at least one flexible member engaging post 208*b* and 258*a* respectively wherein the flexible member engaging posts 208*b* and 258*a* are configured with respect to each other on lateral sides 206" and 256", respectively, to receive a second common flexible member 134 (as shown in FIGS. 1-3).

Similarly, the handle portions 202*a* and 252*a* are configured to include finger gripping portions 210*a* and 260*a* that each defines an enhanced ergonomic kidney-shaped aperture that is configured to receive at least one finger of a person therethrough (not shown).

Figure 6:
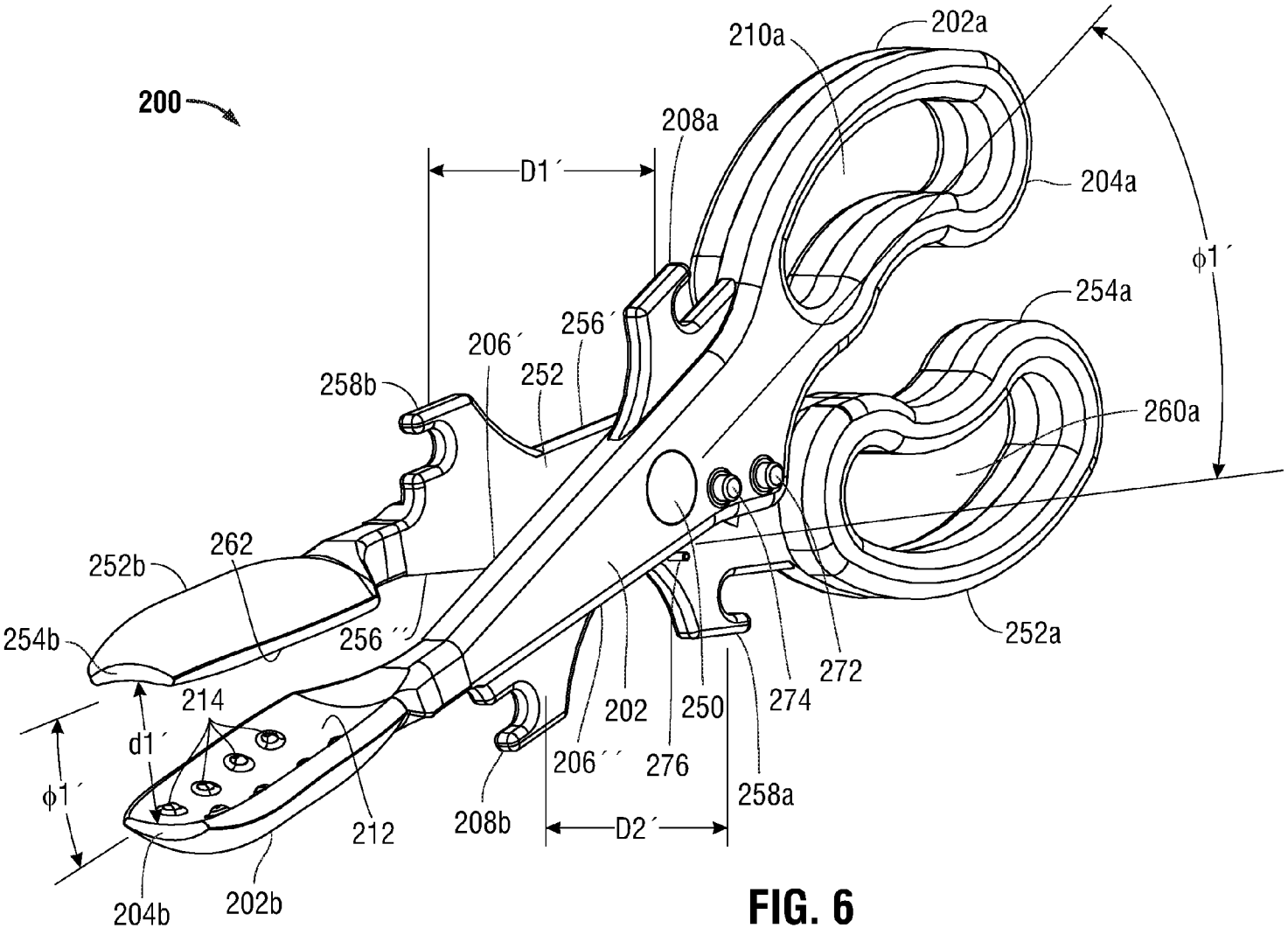
FIG. 6 is a perspective view of the embodiment of the therapeutic device in the form of a pair of variable resistance therapy tongs of FIG. 5 in an open position according to the present disclosure.
Figure 7:
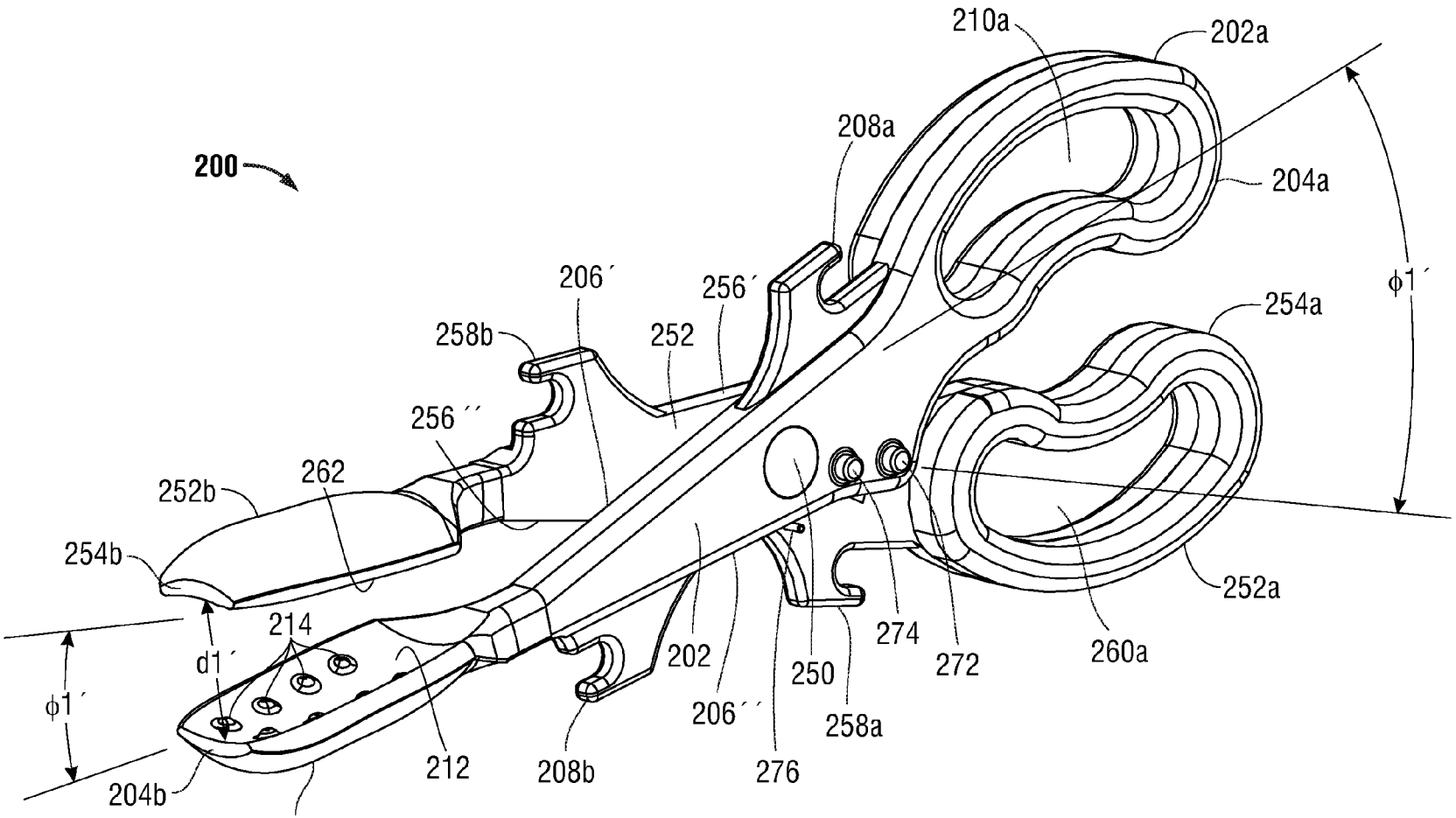
FIG. 7 is a another perspective view of the embodiment of the therapeutic device in the form of a pair of variable resistance therapy tongs of FIG. 5 in an open position according to the present disclosure.

In embodiments, also as illustrated in FIGS. 5-7, the flexible member engaging post 208*a* defined on the handle portion 202*a* of movable member 202 and the flexible member engaging post 258*b* defined on the end effector portion 252*b* of the other movable member 252 define first distance D1' therebetween.

Similarly, the flexible member engaging post 208*b* defined on the end effector portion 202*b* of the movable member 202 and the flexible member engaging post 258*a* defined on the handle portion 252*a* of the other movable member 252 define a second distance D2' therebetween. In the example embodiment of FIGS. 5-7, the first and second distances D1' and D2' are equal to one another.

Again, in a similar manner, the first common flexible member 132, e.g., a rubber band or a shape-memory material as illustrated or a spring (not shown), and the second common flexible member 134 each exhibit a tensile strength or elasticity that provides resistance to movement. In example embodiments, the tensile strength or elasticity of the first common flexible member 132 may equal the tensile strength or elasticity of the second common flexible member 134 such that resistance to movement of the exercise device 200 varies by changes in D1' and D2' during manipulation and also by the difference of D1' as compared to D2' according to the locations of the flexible member engaging posts. In other example embodiments, the tensile strength or elasticity of the first common flexible member 132 may differ from the tensile strength or elasticity of the second common flexible member 134 such that resistance to movement of the exercise device 200 varies not only by changes in D1' and D2' and by the difference of D1' as compared to D2' according to the locations of the flexible member engaging posts but also by the differences between tensile strength or elasticity of the first common flexible member 132 and the second common flexible member 134.

In a similar manner, in embodiments, still referring to FIGS. 5-7, the end effector portions 202*b* and 252*b* may be configured as interfacing grasping cups 212 and 262, respectively, to facilitate grasping of an object, e.g., a ball (not shown), which may be flexible. As compared to the end effector portions 102*b* and 152*b* of FIGS. 1-3, the movable members 202 and 256 include end effector portions 202*b* and 252*b* having a dimpled surface to enhance gripping of the object.

Therapeutic device 200 differs most particularly from therapeutic device 100 in that the pivot 250 functions solely as a pivot and is not actuated by a rotatable knob such as rotatable knob 1501 described above with respect to FIGS. 1-3.

For example, in a similar manner as with respect to exercise device 100, as shown in FIG. 5, the end effector portions 202*b* and 252*b* are positioned in a partially open position wherein the interfacing grasping cups 212 and 262 are generally parallel to each other but spaced apart from one another at an angle Φ1' to effect a maximum distance d1' between the cups 212 and 262.

The interfacing grasping cups 212 and 262 have a dimpled surface 214 (on cup 212—not visible for cup 262) to enhance gripping of an object such as a ball as described above.

In FIGS. 6 and 7, the end effector portions 202*b* and 252*b* are positioned in another open position wherein the interfacing grasping cups 212 and 262 are spaced apart from one another at an angle Φ2' to effect a maximum distance d2' between the cups 212 and 262.

Thus, in a similar manner as described above with respect to exercise device 100, the end effector portions 202*b* and 252*b* pivot in an arc extending in a path defined by at least angles Φ1' and Φ2'.

Referring to FIGS. 5-7, in proximity to the pivot 250 and positioned distally from the handle portion 202*a* on movable member 202 are at least a first rotation limiting member 272 and a second rotation limiting member 274 positioned distally from first rotation limiting member 272 and in proximity to pivot 250.

Figure 8:
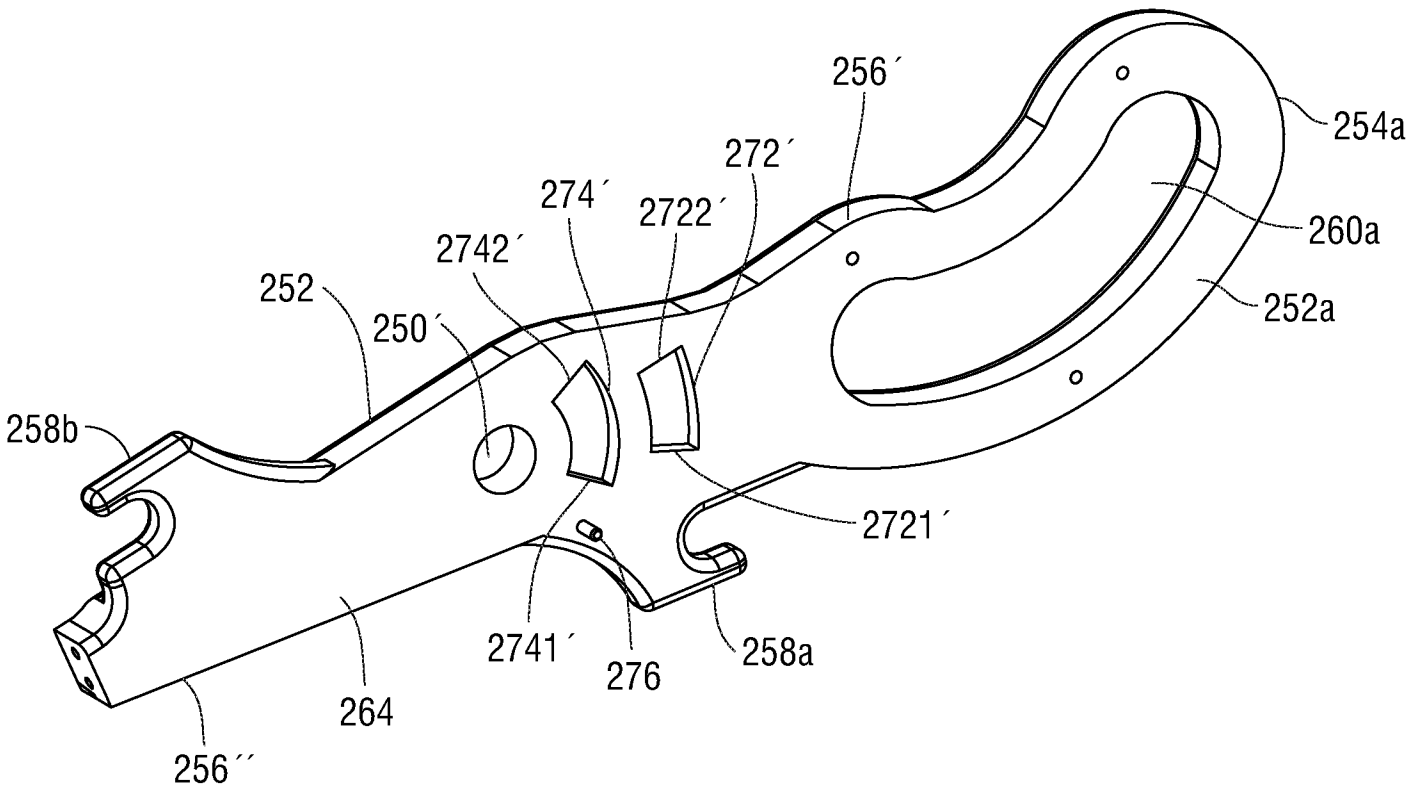
FIG. 8 is a perspective view of one tong of the pair of variable resistance therapy tongs of FIGS. 5 and 6 illustrating operation limiting grooves that limit the movement of the pair of tongs.

Referring to FIG. 8, the movable member 252 defines an aperture 250' configured to receive therethrough the pivot 250 positioned on movable member 202. The movable member 252 further includes operation limiting grooves 272' and 274' that limit the arcs extending in the paths defined by the angles Φ1' and Φ2'. The operation limiting groove 272' limits the arc defined by the lesser of the two angles, i.e., angle Φ1', while the operation limiting groove 274' limits the arc defined by the greater of the two angles, i.e., angle Φ2'. The operation limiting grooves 272' and 274' define depressions in interior surface 264 of movable member 252.

When a person depresses the first rotation limiting member 272 transversely with respect to the longitudinal extension or axis of movable member 202, the first rotation limiting member 272 is received in the operation limiting groove 272' such that pivotal rotation of the movable members 202 and 252 extends in the arc defined by the angle Φ1' that corresponds to an arc defined by groove limiting walls 2721' and 2722'.

The person may release first rotation limiting member 272 from the operation limiting groove 272' by further depressing the first rotation limiting member 272, which is internally spring-loaded. The person may then depress the second rotation limiting member 274 transversely with respect to the longitudinal extension of movable member 202. The second rotation limiting member 274 is then received in the operation limiting groove 274' such that pivotal rotation of the movable members 202 and 252 extends in the arc defined by the angle Φ2' that corresponds to an arc defined by groove limiting walls 2741' and 2742'.

Movement of the movable members 202 and 252 with respect to each other is further limited by a post member 276 positioned on movable member 252 beneath the groove limiting wall 2741'. The post member 276 extends transversely away from interior surface 264 of movable member 252 and serves to further limit pivotal rotation of the movable member 202. Thus, when both the first and second rotation limiting members 272 and 274 are disengaged from the operation limiting grooves 272' and 274', the post member 276 serves to define a maximum open position between the movable members 202 and 252.

Figure 9:
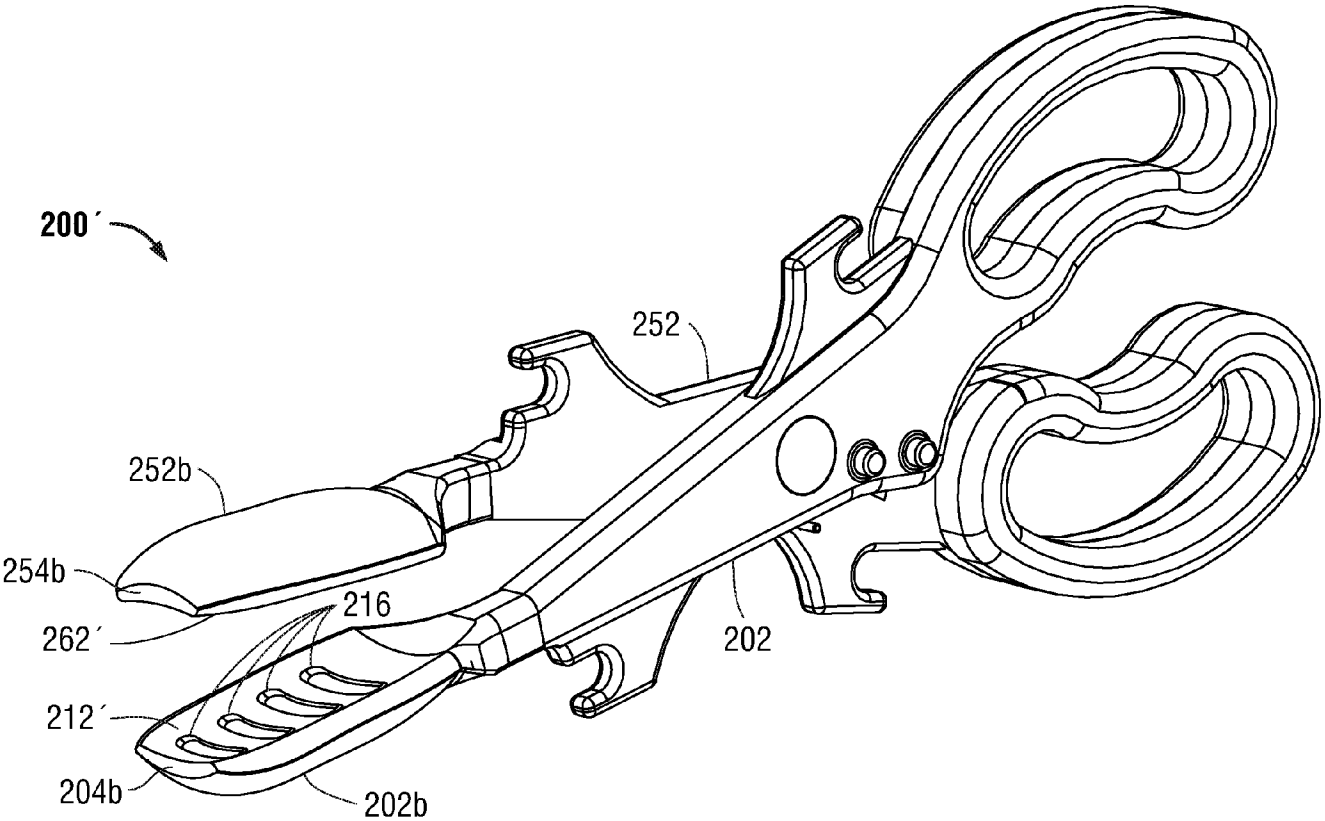
FIG. 9 is a perspective view of yet another embodiment of a therapeutic device in the form of a pair of variable resistance therapy tongs in a partially open position according to the present disclosure wherein the tongs include graspers having a ridged surface to enhance gripping.

FIG. 9 is a perspective view of yet another embodiment of the therapeutic exercise device 200 in a partially open position. Hand-held therapeutic exercise device 200' is identical to hand-held therapeutic exercise device 200 except that end effectors 202*b* and 252*b* include interfacing grasping cups 212' and 262' wherein the interfacing grasping cups 212' and 262' have a ridged surface 216 (on cup 212'—not visible for cup 262') to enhance gripping of an object such as a ball, as described above.

As can be appreciated by the foregoing description of hand-held therapeutic exercise devices 100, 200 and 200', the movable members 102 and 202 have been illustrated in the figures as being positioned and designed for operation on the left side of the respective device while movable members 152 and 252 have been illustrated in the figures as being positioned and designed for operation on the right side of the respective device. Those skilled in the art will recognize that the left movable member may instead be constructed as a mirror image of the right movable member as described herein and, vice versa, the right movable member may instead be constructed as a mirror image of the left movable member as described herein. Alternatively, the person may flip the device around its longitudinal axis so that the left movable member becomes the right movable member and the right movable member becomes the left movable member.

Referring to FIGS. 1-9, it can be appreciated also that the foregoing description of hand-held therapeutic exercise devices 100, 200 and 200' relates also to a method of therapeutic exercise that includes accessing a therapeutic hand-held exercise device, e.g., hand-held therapeutic exercise device 100, 200 or 200', that includes a pair of movable members, e.g., movable members 102 and 152 or 202 and 252, each defining a handle portion, e.g., handle portions 102*a* and 152*a* or 202*a* and 252*a*, and an end effector portion, e.g., end effector portions 102*b* and 152*b* or 202*b* and 252*b*. The movable members are pivotably connected at a pivot, e.g., pivot 150 or 250, located between the handle portion and the end effector portion for relative pivotal movement between a first position and a second position. The therapeutic hand-held exercise device also includes at least one common flexible member, e.g., common flexible member 132 and/or 134, that provides resistance to the relative pivotal movement. The method includes manipulating the therapeutic hand-held exercise device via the handle portion such that the resistance to the relative pivotal movement imparts therapeutic effect.

The method may further include varying the resistance to the relative pivotal movement of the therapeutic hand-held exercise device.

Still further, the method may further include grasping an object via the end effector portion via the pivotal movement of the therapeutic hand-held exercise device and manipulating the therapeutic hand-held exercise device via the handle portion such that resistance of the object to the relative pivotal movement imparts therapeutic effect.

It should be noted that a medical professional such as a doctor or therapist may advise a patient to operate the therapeutic exercise devices 100, 200 or 200' initially by varying the relative pivotal movement such as by manipulating the device first through the arc defined by angle Φ1 or Φ1'. Further therapeutic effect may be imparted by then manipulating the device through the greater arc defined by angle Φ2 or Φ2' and still further by operating in the arc determined by post member 276. In addition, a person may recognize by himself or herself the therapeutic benefits of operating the therapeutic exercise devices 100, 200 or 200' in the foregoing manner. Still further, it may be recognized by a person himself or herself whose motor skills are compromised and who is seeking a device to perform one or more utensil functions that the therapeutic exercise devices 100, 200 or 200' may perform the one or more utensil functions during operation while also providing therapeutic benefits towards the compromised motor skills as though the device or devices were operated intentionally in the foregoing manner without regard to utensil function.

While several embodiments and methodologies of the present disclosure have been described and shown in the drawings, it is not intended that the present disclosure be limited thereto, as it is intended that the present disclosure be as broad in scope as the art will allow and that the specification be read likewise. Therefore, the above description should not be construed as limiting, but merely as exemplifications of particular embodiments and methodologies. Those skilled in the art will envision other modifications within the scope of the claims appended hereto.

What is claimed is:

1. A therapeutic hand-held exercise device comprising:

a first arm including a first handle and a first end effector, the first handle including a first post;

a second arm including a second handle and a second end effector, the second end effector including a second post;

a pivot that connects the first and second arms together to enable the first and second handles to move between an first position and an second position; and a first flexible link supported on the first and second posts and configured to urge the first and second handles toward the first position to selectively provide therapeutic exercise to a single hand of a user when the single hand of the user grasps the first and second handles and simultaneously applies force and counterforce through the first and second handles to move the first and second handles between the first and second positions, wherein the first position and the second position are each selected from the group consisting of: the closed position, the nearly closed position, the open position, the extended open position, and the partially open position, and wherein the first position and the second position are different positions.

2. The therapeutic hand-held exercise device of claim 1, wherein the first flexible link includes shape memory material, a rubber band, a spring, or combinations thereof.

3. The therapeutic hand-held exercise device of claim 1, wherein the second handle includes a third post and the first end effector includes a fourth post, the third and fourth posts supporting a second flexible link.

4. The therapeutic hand-held exercise device of claim 3, wherein the second flexible link includes shape memory material, a band, a spring, or combinations thereof.

5. The therapeutic hand-held exercise device of claim 3, wherein the first and second posts are separated by a first distance, and the third and fourth posts are separated by a second distance.

6. The therapeutic hand-held exercise device of claim 5, wherein the first and second distances are different.

7. The therapeutic hand-held exercise device of claim 3, wherein the tensile strength of the first flexible link is different from the tensile strength of the second flexible link.

8. The therapeutic hand-held exercise device of claim 1, wherein the first handle defines an aperture configured to receive a first finger of the single hand.

9. The therapeutic hand-held exercise device of claim 8, wherein the second handle defines an aperture configured to receive a second finger of the single hand.

10. Therapeutic hand-held exercise device of claim 1, wherein the each end effector includes a cup.

11. The therapeutic hand-held exercise device of claim 10, wherein one of the cups includes surface texturing to facilitate grasping of an object.

12. The therapeutic hand-held exercise device of claim 11, wherein the surface texturing includes dimples, ridges, or combinations thereof.

13. Therapeutic hand-held exercise device of claim 1, wherein each effector includes a blade.

14. Therapeutic hand-held exercise device of claim 1, wherein the first arm defines an operation-limiting groove and the second arm supports a rotation-limiting pin, the rotation-limiting pin is selectively positionable in the operation-limiting groove to limit pivoting movement between the first and second arms.

15. The therapeutic hand-held exercise device of claim 14, wherein the rotation-limiting pin is spring loaded.

16. Therapeutic hand-held exercise device of claim 14, further including a stop post member that limits pivoting movement between the first and second arms.

* * * * *